United States Patent [19]

Hatch, Jr.

[11] Patent Number: 4,863,397

[45] Date of Patent: Sep. 5, 1989

[54] EXPENDABLE FRANGIBLE ELECTRICAL CONNECTOR

[76] Inventor: William K. Hatch, Jr., 211 SW. 87 Ter., Plantation, Fla. 33324

[21] Appl. No.: 184,826

[22] Filed: Apr. 22, 1988

[51] Int. Cl.[4] ..... H01R 13/00

[52] U.S. Cl. ..... 439/475

[58] Field of Search ..... 439/154, 475

[56] References Cited

U.S. PATENT DOCUMENTS

| | | | |
|---|---|---|---|
| 3,072,021 | 1/1963 | Marcon | 439/154 |
| 3,136,842 | 6/1964 | Perkins et al. | 439/154 |
| 3,887,257 | 6/1975 | Panek et al. | 439/154 |

*Primary Examiner*—Joseph H. McGlynn

*Attorney, Agent, or Firm*—Alvin S. Blum

[57] ABSTRACT

A breakaway electrical connector particularly suited for the electrical conduit providing electrical connections to a fuel dispenser reduces damage to the dispenser when the dispenser is accidentally dislodged in an accident and reduces the danger of fire and explosion. The connector includes an outer shell with a circumferential weakness at a shear plane and conductors within the shell arranged to break apart at the shear plane. The conductor breaks apart at a force less than the force required to damage other elements in the dispenser and conduit. The connector is easily removed and replaced, but cannot be reused once it separates to prevent reuse of a damaged connector.

15 Claims, 4 Drawing Sheets

EXPENDABLE FRANGIBLE ELECTRICAL CONNECTOR

This invention relates to multiconductor electrical connectors, and more particularly to connectors for fuel pumps that will disconnect and break away without fire or explosion before disruption and damage of other electrical components of the fuel pump and its connections.

BACKGROUND OF THE INVENTION

Fuel pumps at filling stations are connected to fuel storage tanks by underground fuel pipes. The electrical controls and operations are provided by electrical wires passing through rigid explosion-proof conduits connected to a primary junction box within the fuel pump cabinet. The pumps are exposed to trauma from the vehicles they serve, either from collision or driving away with the hose in the vehicle fill port. When the pump is knocked or pulled from its foundation, the fuel pipe and the electrical conduit anchored in the ground break loose at some point. A break away connection with check valve is provided in the fuel line so that the fuel spill is limited. There is no provision in current practice for a breakaway connector in the electrical line. The electrical wires may tear loose at any point with the obvious dangers of fire and explosion. Furthermore, the electric conduit below ground is filled with a filling material after the wires are passed to prevent fuel or fumes from entering voids therein. Consequently, rewiring and repairing damage to the electrical system after an accident is very expensive and time consuming because new wires cannot be passed through the filled conduits.

SUMMARY OF THE INVENTION

It is accordingly an object of the invention to provide an electrical connection that will break away before damage to other elements of the electrical system in the event of an accident. It is a further object that the breaking away reduce the risk of fire and explosion. It is a further object that the breaking away destroy the connector so that it must be replaced to prevent reuse of a possibly defective connector. The connector of the invention includes an expendable frangible element that provides conduction pathways for a plurality of conductors insulated from one another with means preventing interaction between the conductors during the breaking away process. The connector is easily replaced in the system without rewiring. A rigid conduit system conducts the underground wires to the junction box in the fuel pump cabinet. The frangible connector of the invention includes a frangible rigid outer member that connects in line with other rigid conduit elements so that there is continuity, both for grounding and rigidity, of the conduit system until the frangible connector breaks, including spring means to pull the broken ends apart at time of breaking. When the fuel pump is returned to its original position, each of the broken ends of the connector is unscrewed and unplugged from its unaffected mating connector, and a new, unbroken connector is plugged and screwed in place.

These and other objects and advantages of the invention will become evident from the following detailed description of the presently preferred embodiments thereof with reference to the appended drawings in which:

DETAILED DESCRIPTION OF PREFERRED EMBODIMENTS

Figure 1:
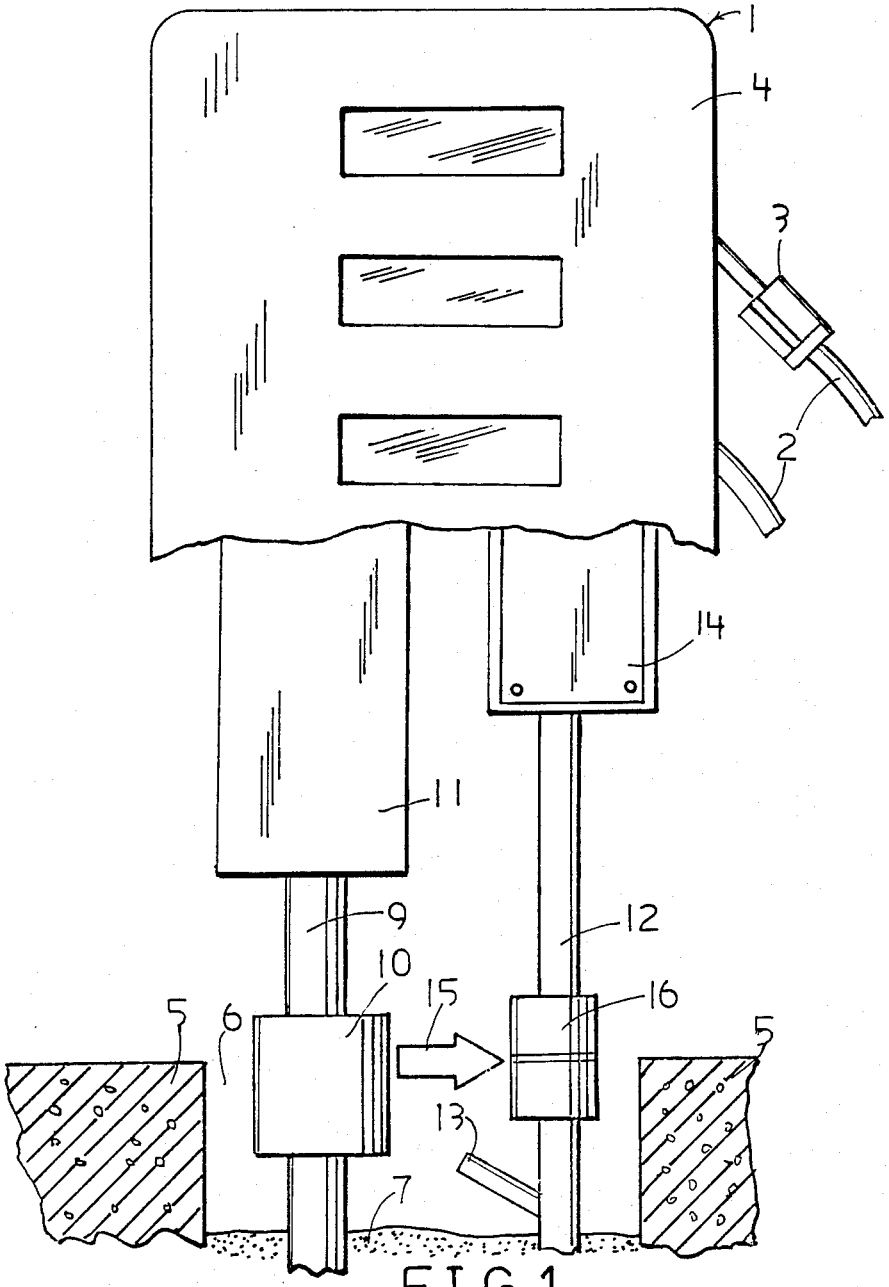
FIG. 1 is a front elevation view of a gasoline pump installation with a portion cut away to show the electrical connector of the invention in use.

Referring now first to FIG. 1 a fuel dispensing unit installation for dispensing gasoline, diesel fuel and the like is shown as a typical application for the invention. An elevated concrete island 5 is shown cut away to reveal recess 6 beneath the dispenser 1 whose partially broken away cabinet 4 ordinarily conceals the recess and the connections of dispsnser to underground utilities. Coming up through the soil 7 is a fuel pipe 9 from an underground storage tank and an electrical conduit 12 carrying a plurality of electrical wires to junction box 14 to supply electric power and to convey signals to and from a remote location. The fuel dispensing nozzle 3 may be accidentally left in the vehicle and driven away, pulling on hose 2 and ripping the dispenser off its foundation or a vehicle may collide with the dispenser. The art provides a special check valve assembly 10 in the fuel pipe 9 so that if the pipe is torn loose, valves automatically close to cut off the fuel supply going to pump 11.

Figure 2:
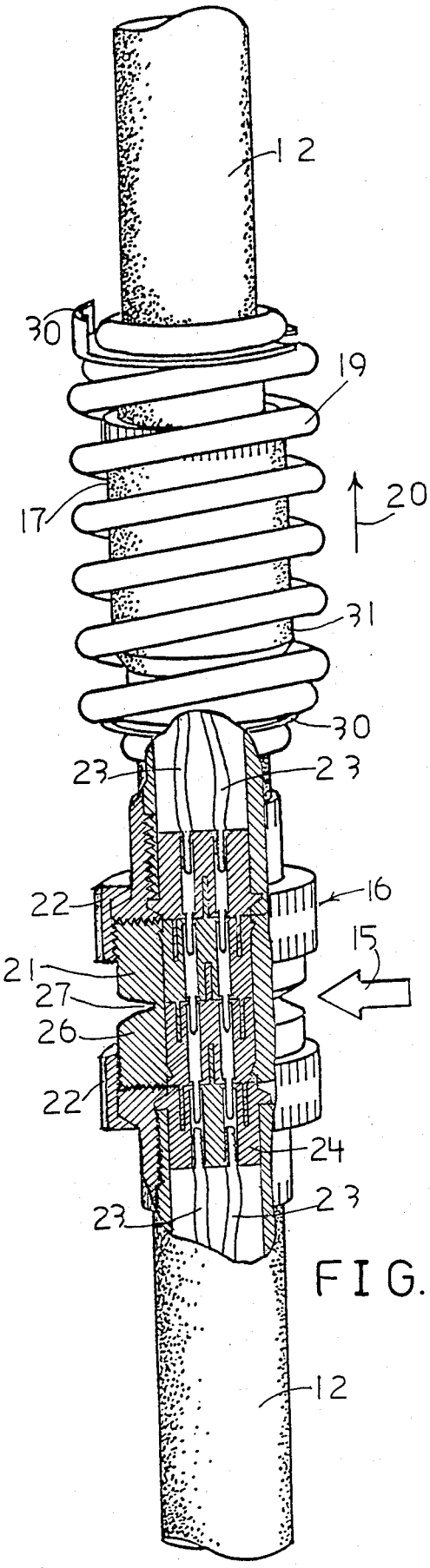
FIG. 2 is a front elevation view of the connector in a conduit with a portion cut away.
Figure 3:
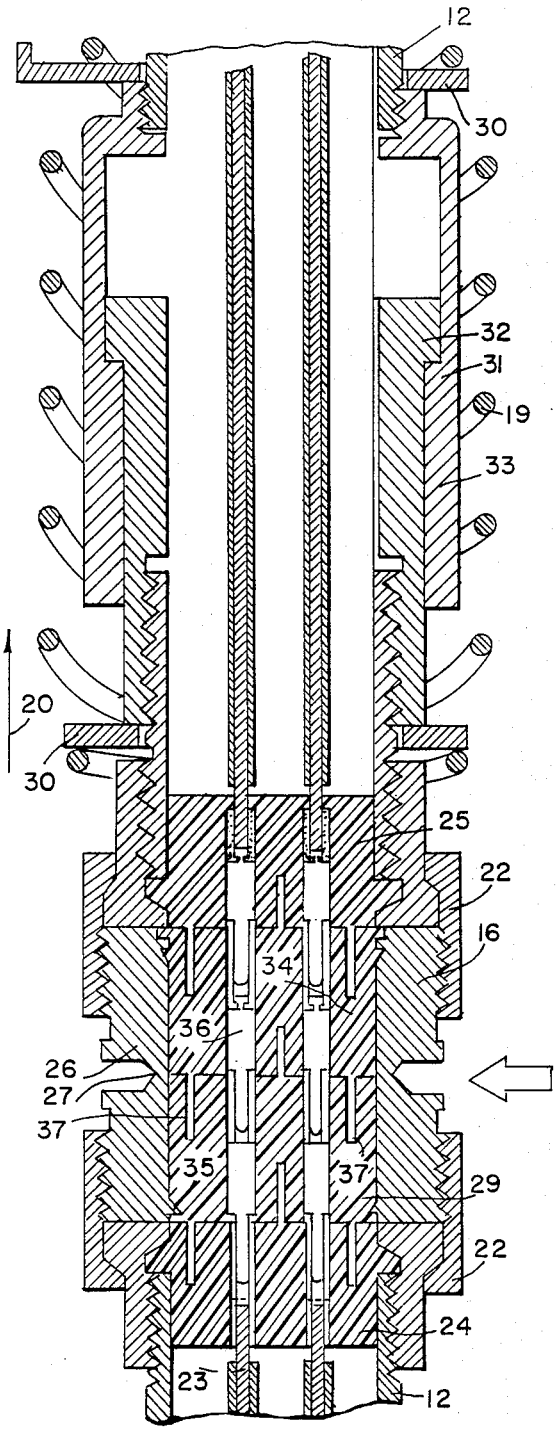
FIG. 3 is a cross sectional view of FIG. 2.
Figure 4:
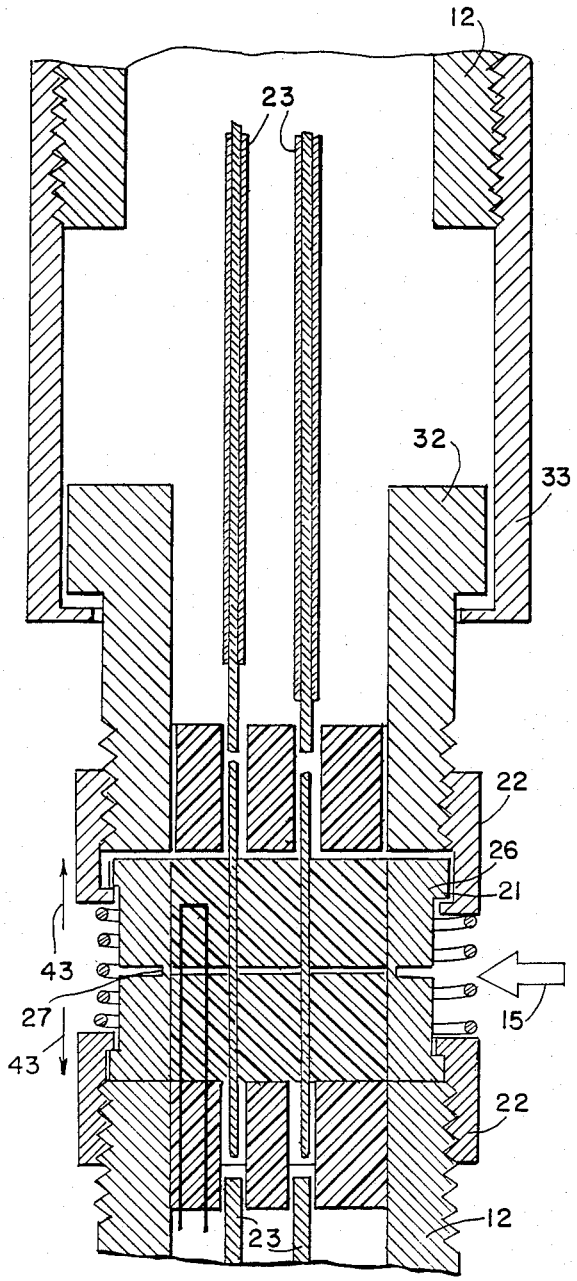
FIG. 4 is a cross sectional view of an alternative embodiment of the connector.

Safety feature provided in the electrical conduit system of the prior art include a Y-joint connector 13 for insertion of a sealing compound that fills the lowermost portion of the conduit to block the passage of fuel in liquid or vapor form. The conduit 12 and junction box 14 are rigid and explosion-proof. In the prior art, the connector 16 is a sliding, explosion-proof union and expansion coupling of the type described by Appleton in U.S. Pat. No. 2,900,436 to rigidly join the portions of the conduit while providing an axial adjustment. When the dispenser 1 is pulled or pushed from its foundation, stresses on the electrical conduit 12 can cause extensive damage to other elements. Pulling apart the wires can cause arcing, fires, and explosions. The connector 16 of the invention includes a breakaway electrical connector that will break apart at the level of arrow 15 before enough force is generated to damage any other elements of the system. The connector of the invention further includes means to prevent fires or explosions during the process of breaking away, thereby greatly reducing danger to personnel and the costs of repair. As shown in FIGS. 2 and 3 the connector 16 rigidly connects by screw thread connection to upper and lower portion of conduit 12. A sliding expansion union 17 of the type well known in the art includes an inner member 32 sliding inside an outer member 31 with minimum clearance therebetween to prevent explosion by providing a tortuous path between metal walls to cool hot gases. The sliding fitting provides axial clearance when connecting the rigid conduit system. An extension spring 19 held in place by collars 30 applies tension in the direction of arrow 20, tending to pull inner member 32 upward. This tension is transmitted to the frangible cartridge 21 comprised of an outer shell 26 rigidly connected by screw nuts 22 to inner member 32 of union 17 at its upper end and conduit 12 at its lower end. The shell has a circumferencial groove 27 that greatly weakens it at this point to ensure that the cartridge will break apart at this point before undue stress damages other conduit elements. The bias of spring 19 ensures that the two broken parts will be rapidly pulled apart on breaking to reduce electrical arcing. A lower body portion 29 and an upper body portion 34 are separate from one another but firmly attached to shell 26 so that they will be pulled away from each other when the shell 26 breaks apart. The two inner body portions meet each other at a plane that coincides with the weakening groove 27 in the outer shell. Fixing elements 35 hold body portions 29 and 34 to the outer shell. The body portions 29 and 34 are electrically insulating plastic with holes therethrough for the electrical conductors. For illustrative purposes only two conductors 36 are shown. Ordinarily many more conductors are used. Some carry only small signals while others carry considerable current for operating pumps, lights and the like. The conductors 36 have a socket upper portion and a pin lower portion for electrical engagement with complementary contacts in upper and lower conductors. The pins of the conductors in the upper body portion 34 engage the sockets of the conductors of the lower body portion 29 to provide electrical continuity through the frangible cartridge 21. When shell 26 breaks apart at groove 27, spring 19 pulls the upper body portion 34 upward and away from the lower body portion 29 and the pins of the conductors of the upper body portion are pulled out of the sockets of the conductors of the lower body portion. The plastic of the upper body portion 34 extends in sleeve-like projection 37 into a corresponding recess in the lower body portion 29. This sleeve encloses the electrical contacts until they have been separated because it is longer than the pins. This prevents the atmosphere of the cabinet and any explosive fumes from reaching the contacts until any change of arcing has passed. The upper end of the upper body portion 34 has electrical mating means for engaging pin contacts of upper mating connector 25 and the lower end of the lower body portion 29 has mating means for engaging the socket contacts of the lower mating connector 24. The upper and lower mating connectors have means 39 for connecting to wires 23 of the conduit system. When the frangible cartridge 21 breaks apart, it cannot be reused. It is easily removed by unscrewing the two screw nuts 22 and unpluging the upper portion from the upper connector 25 and the lower portion from the lower connector 24. A new cartridge is then plugged in and screwed in place with nuts 22.

Figure 5:
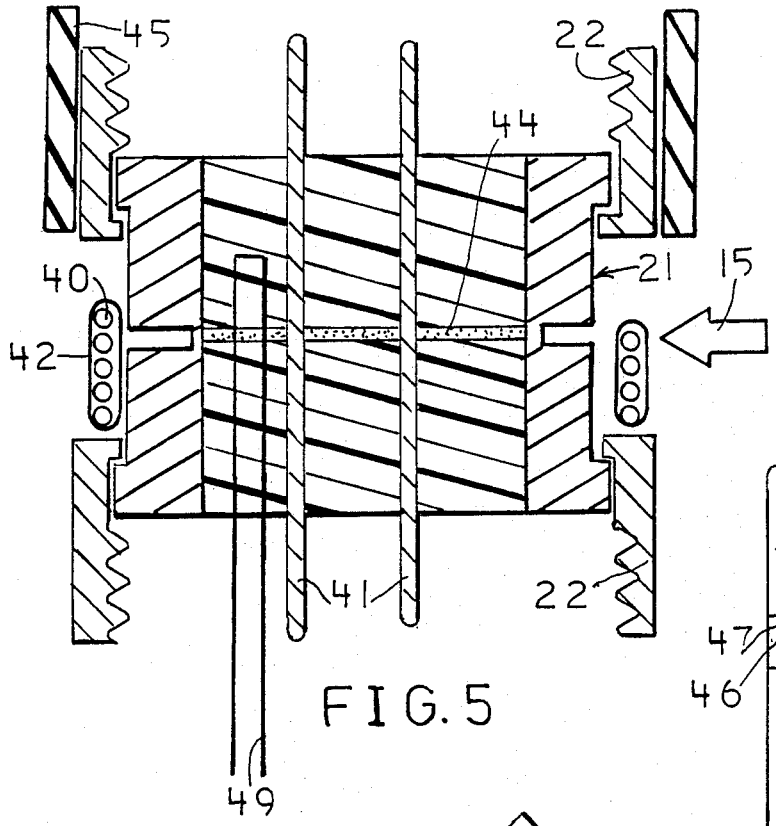
FIG. 5 is a cross sectional detail of the cartridge portion of the connector of FIG. 4 prior to installation.
Figure 7:
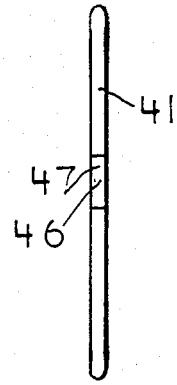
FIG. 7 is a frangible pin of the invention in front elevation.
Figure 6:
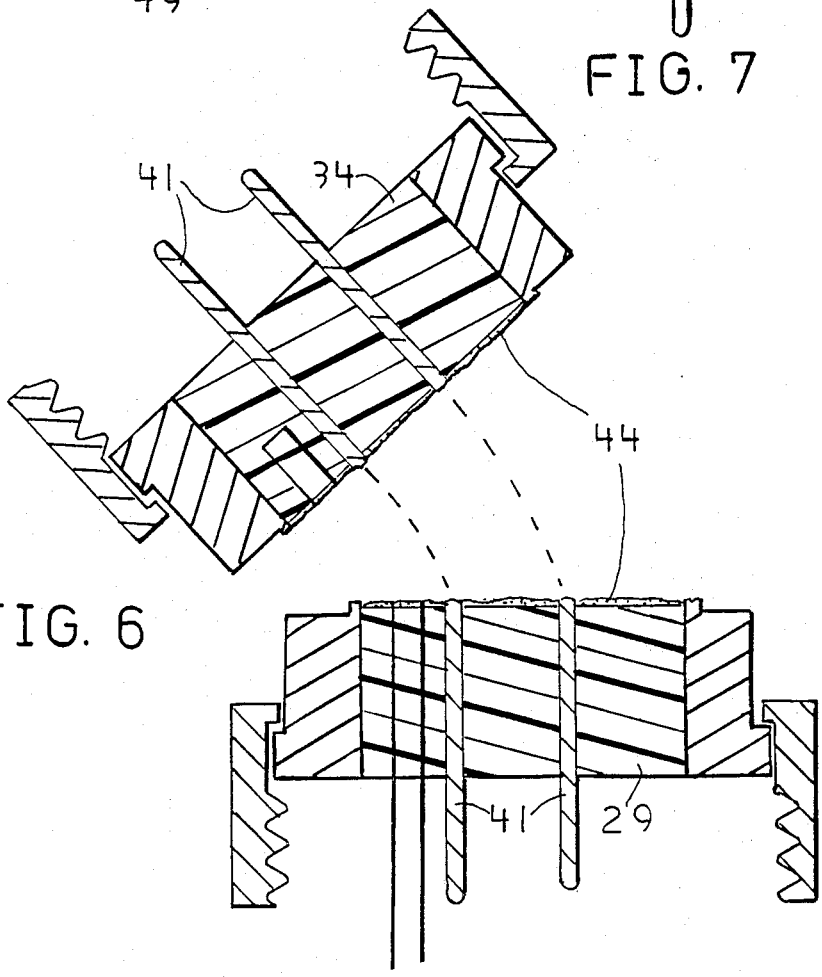
FIG. 6 is a cross sectional detail of the cartridge of FIG. 4 as it would be broken apart in an accident.

FIGS. 4–7 show an alternative embodiment of the invention, in which a compression spring 40 exerts a spring bias on screw nuts 22 that are held captive on outer shell 26 of frangible cartridge 21 having circumferential groove 27 forming a weakened region at which the cartridge will fracture before other parts of the system can be damaged, when stresses are accidentially applied to the conduit system. The cartridge 21 is shown in the detail of FIG. 5 with frangible pins 41 extending completely through both lower body portion 29 and upper body portion 34 for mating electrically with the socket contacts of lower mating connector 24 and upper mating connector 25 respectively. The cartridge is shown in FIG. 5 as it might appear before installation. The spring 40 is held tightly compressed by loops 42 of wire or tape to facilitate installation. After installation, the loops 42 are cut, freeing the spring to force the screw nuts 22 apart as indicated by arrows 43 that will force the two halves of the broken cartridge apart as in FIG. 6. The frangible pins 41 are fixedly embedded in lower body portion 29 and upper body portion 34 and the two body portions are separated by a separation phase 44 that may be a silicone rubber membrane that is easily torn away and to which the frangible pins 41 are not adherent. When forces tend to pull or shear the upper body portion 34 from the lower body portion 29, the pins are secured along their lengths in the plastic of both body portions, but are unsupported in the thickness of the separation phase (a thickness of two millimeters is recommended) through which they pass. The pins will therefore break at this point, leaving no broken parts exposed for accidentally making contact and sparking. A resilient rubber sleeve 45 may be pulled down to bridge the gap between screw nuts 22 after installation. This forms a resilient barrier to passage of flammable fluids into the separation zone at the time of breaking when electric arcs may be produced to enhance the explosion-proof operation. The frangible pins may be made of a frangible material such as beryllium copper heat treated to brittleness. Optionally, the pin as shown in FIG. 7 may be partially cut through at 46 to enhance breaking at the separation phase. Alternatively, the pin may be a composite with the center zone 47 of a frangible material such as a coil of copper foil or a glass tube filled with copper or silver powder or a brittle conductive plastic. A loop of wire 49 may be embedded in both body portions as shown. This wire is in series with a holding relay circuit providing electric power to the dispenser. When this wire breaks, all electric power coming through conduit 12 is cut off instantly to further reduce hazards of fire and explosion. Because very little current need flow through the holding relay circuit, this can be a very fine wire that is easily broken.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. An expandable, easily replaceable, frangible connector assembly for a plurality of electrical circuits passing through a conduit means that will safely break apart and disconnect said circuits before other portions of said circuits or conduit means can suffer damage when disruptive forces are accidentally applied to said conduit means, comprising:

(a) a rigid body shell means with two ends having conduit connecting means said conduit connecting means for connecting each of said ends to said conduit means at conduit connectors to provide rigidity, electrical ground continuity and explosion-proof properties to said conduit means;

(b) a pair of body portions made of insulating material, each said body portion having two ends and a plurality of electrical conductors passing through both said body portions, with a first end of each pair in abutting relationship at a shear plane and a second, opposite end of each pair having electrical conductor connecting means for providing electrical continuity to said electrical circuits with conductors in said conduit means, with each of said body portions fixedly connected to said body shell means, said conductors separable at said shear plane into upper conductor segments and lower conductor segments;

(c) said body shell means including a circumferentially weakened portion at said shear plane to ensure separation of said connector into two parts under said disruptive forces, before damage to other portions of said circuits or conduit means, said two parts comprising a first part including an upper portion of said shell means enclosing a first body portion with upper conductor segments and a second part including a lower portion of said shell means enclosing a second body portion with lower conductor segments, each of said two parts remaining connected to said conduit means at said conduit connectors and maintaining connections at said conduit means undamaged for easy removal of said two parts and replacement by an undamaged connector assembly.

2. The connector assembly according to claim 1 further comprising spring bias means for forcing away axially said two parts of said connector when said connector breaks apart to reduce electrical interaction between said conductor segments.

3. The connector assembly according to claim 1 in which said circumferential weakening includes a groove in said shell means.

4. The connector assembly according to claim 1 in which said conductors are separable at said shear plane by an electrical and mechanical joint means between each said upper and lower conductor segment.

5. The connector assembly according to claim 1 in which said conductors are separable at said shear plane by means of conductors having a frangible structure and adhering means fixedly adhering said conductors to each of said body portions throughout the passage of said conductors through said body portions, leaving an unadhered gap at said shear plane at which point said conductors are unsupported against breakage.

6. The connector assembly according to claim 5 in which said conductors include a frangible portion at said shear plane.

7. The connector assembly according to claim 6 in which said frangible portion comprises a conductive power in a glass tube.

8. The connector assembly according to claim 6 in which said frangible portion comprises a roll of conductive foil.

9. The connector assembly according to claim 6 in which said frangible portion is a brittle conductive plastic.

10. The connector assembly according to claim 6 in which said frangible portion is partically cut through.

11. The connector assembly according to claim 1 in which said conductors include a circuit for cutting off all electric power supplied to said conduit means.

12. The connector assembly according to claim 1 in which a first of said body portions includes shielding sleeve means projecting into sleeve recess means in said second body portion, said shielding sleeve means shielding conductors from the atmosphere surrounding said conduit means during their separation to prevent fire and explosion.

13. The connector assembly according to claim 1 in which said body shell means includes resilient sleeve means for shielding said conductors from the atmosphere surrounding said conduit means during their separation to prevent fire and explosion.

14. The invention according to claim 1 further comprising a sliding expansion union adapted for connection to one end of said connector.

15. The connector assembly according to claim 1, in which said conduit connecting means includes axial plug means and screw connection means.

* * * * *